US010976121B2

(12) United States Patent
Draper

(10) Patent No.: US 10,976,121 B2
(45) Date of Patent: Apr. 13, 2021

(54) FIREARM MAGAZINE LOADER

(71) Applicant: Corey R. Draper, Mayville, MI (US)

(72) Inventor: Corey R. Draper, Mayville, MI (US)

( * ) Notice: Subject to any disclaimer, the term of this patent is extended or adjusted under 35 U.S.C. 154(b) by 191 days.

(21) Appl. No.: 15/406,706

(22) Filed: Jan. 14, 2017

(65) Prior Publication Data

US 2018/0202735 A1 Jul. 19, 2018

(51) Int. Cl.
*F41A 9/83* (2006.01)
*F41A 9/82* (2006.01)

(52) U.S. Cl.
CPC . *F41A 9/83* (2013.01); *F41A 9/82* (2013.01)

(58) Field of Classification Search
CPC ..... F41A 9/82; F41A 9/83; F41A 9/84
See application file for complete search history.

(56) References Cited

U.S. PATENT DOCUMENTS 4,719,715 A * 1/1988 Howard ..... F41A 9/83 42/87
7,637,048 B2 12/2009 Tal
8,356,441 B2 1/2013 Meinel
9,091,500 B1 * 7/2015 Kim ..... F41A 9/83
2008/0184608 A1 * 8/2008 Tal ..... F41A 9/83 42/87
2014/0298704 A1 * 10/2014 Niccum ..... F41A 9/83 42/87
2017/0051992 A1 * 2/2017 Cottrell ..... F41A 9/83
2018/0058785 A1 * 3/2018 Hefer ..... F41A 9/83
2018/0080729 A1 * 3/2018 Couie ..... F41A 9/83

FOREIGN PATENT DOCUMENTS

GB 2189873 A * 11/1987 ..... F41A 9/83

* cited by examiner

*Primary Examiner* — Gabriel J. Klein
(74) *Attorney, Agent, or Firm* — Inventa Capital PLC

(57) ABSTRACT

A firearm magazine loader includes a housing and a magazine guide. The magazine guide is at least partially received within the housing. The magazine guide defines a magazine guide cartridge portal that is proximately aligned with a housing guide cover channel. The magazine guide coordinates the movement of a guide slide coupled to the housing. The magazine guide cartridge portal receives the firearm cartridge and the guide slide maneuvers the firearm cartridge into the firearm magazine.

9 Claims, 7 Drawing Sheets

FIREARM MAGAZINE LOADER

TECHNICAL FIELD

The present disclosure relates to a firearm magazine loader.

BACKGROUND

Firearm magazines are usually loaded with ammunition by hand, which is a tedious manual process. The process of hand-loading requires a fair amount of manual dexterity and finger strength. Generally hand-loading a detachable magazine requires the use of both hands; one hand to hold steady the magazine body and the other hand to align the cartridge for insertion and apply pressure to feed the cartridge through the tapered edges on the magazine portal. The hand-loading process is slow and laborious. Accordingly, it is desirable to provide a firearm magazine loader that is: (1) simple to assemble, (2) simple to prepare, and (3) simple to operate for loading cartridges into a detachable firearm magazine.

SUMMARY

In at least one embodiment, the firearm magazine loader is shown. The firearm magazine loader includes a housing and a magazine guide. The housing has a housing aft wall that is disposed opposite a housing fore wall, a housing left wall that extends between the housing aft wall and the housing fore wall, and a housing right wall that is disposed opposite the housing left wall that extends between the housing aft wall and the housing fore wall, the housing aft wall defining a housing cover channel that extends from a housing top towards a housing guide slide panhandle shelf disposed proximate a housing bottom. The magazine guide is at least partially received within the housing, the magazine guide having a magazine guide aft wall that is disposed opposite a magazine guide fore wall and that is disposed proximate and substantially parallel to the housing aft wall, a magazine guide left wall that extends between the magazine guide aft wall and the magazine guide fore wall, and a magazine guide right wall that is disposed opposite the magazine guide left wall and that extends between the magazine guide aft wall and the magazine guide fore wall, the magazine guide aft wall defining a magazine guide cartridge portal that is proximately aligned with the housing guide cover channel.

In at least one embodiment, the firearm magazine loader is shown. The firearm magazine loader includes a housing, a magazine guide and a guide slide. The housing having a housing guide slide pocket that is defined by a housing bottom and a housing aft wall extending from the housing bottom, a housing left wall disposed adjacent to the housing aft wall and extending from the housing bottom, a housing fore wall disposed adjacent to the housing left wall and extending from the housing bottom, and a housing right wall disposed adjacent to the housing fore wall and extending from the housing bottom. The magazine guide is partially received within the housing guide slide pocket, the magazine guide having a magazine guide aft wall, a magazine guide left wall that is disposed adjacent to the magazine aft wall, a magazine guide fore wall that is disposed adjacent to the magazine guide left wall, a magazine guide right wall that is disposed adjacent to the magazine guide fore wall. The guide slide is received within the housing guide slide pocket, the guide slide having a guide slide panhandle that extends from the guide slide aft face and extends through the housing aft wall, a guide slide stop that extends from the guide slide fore face and is disposed proximate the housing fore wall, a guide slide top having a guide slide groove extending between the guide slide stop and the guide slide panhandle, and a guide slide left face and a guide slide right face each extending from the guide slide top towards a guide slide bottom that engages the housing bottom.

DETAILED DESCRIPTION

As required, detailed embodiments of the present disclosure are disclosed herein; however, it is to be understood that the disclosed embodiments are merely exemplary of the present disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Throughout this specification, the term "attach," "attachment," "connected," "coupled," "coupling," "mount," or "mounting" shall be interpreted to mean that a structural component or element is in some manner connected to or contacts another element, either directly or indirectly through at least one intervening structural element, or is integrally formed with the other structural element.

Figure 1:
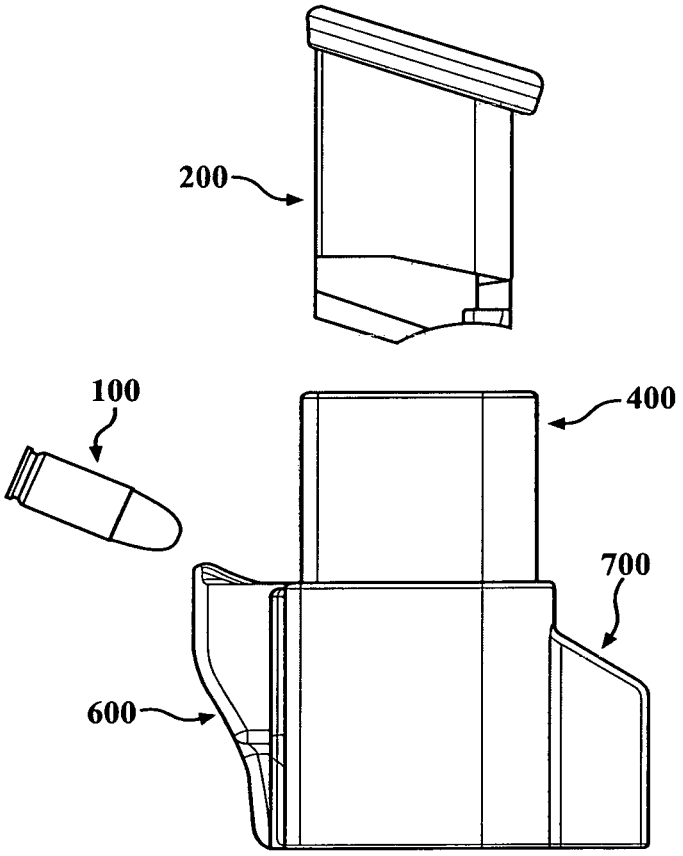
FIG. 1 is right side view of the firearm magazine loader, a firearm cartridge, and a magazine.
Figure 2:
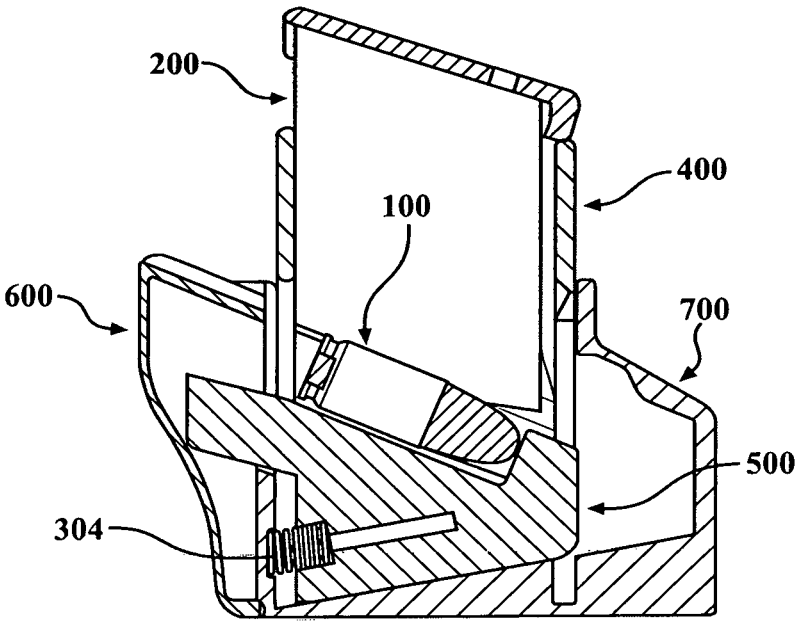
FIG. 2 is a cross-section view of the firearm magazine loader, and a magazine, with a firearm cartridge being loaded into the firearm magazine.
Figure 3:
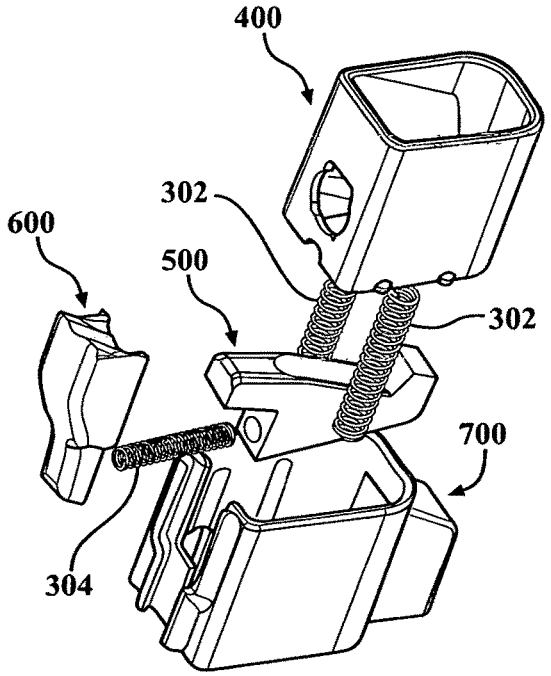
FIG. 3 is a disassembled isometric view of the firearm magazine loader.
Figure 4:
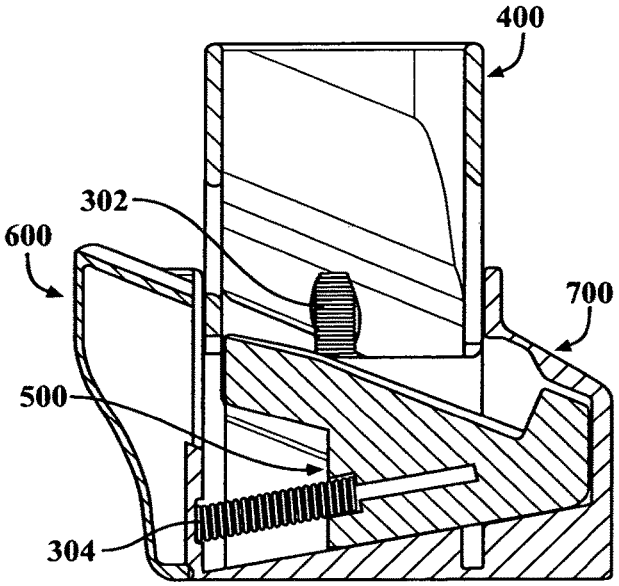
FIG. 4 is a cross-section view of the firearm magazine loader.
Figure 5:
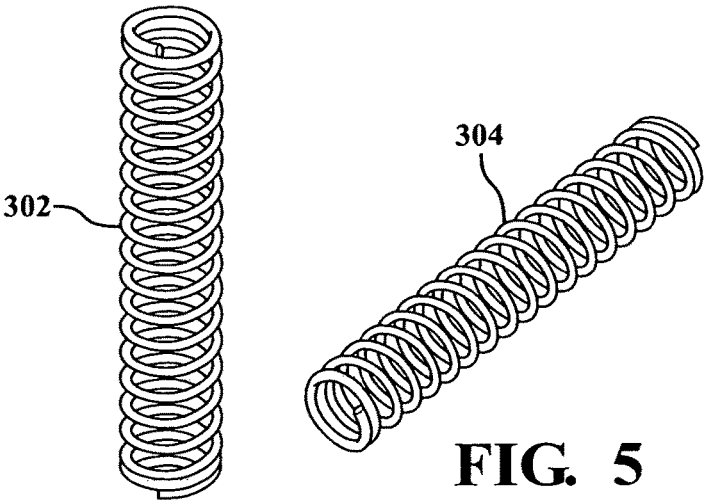
FIG. 5 is a view of the firearm magazine loader springs.
Figure 6:
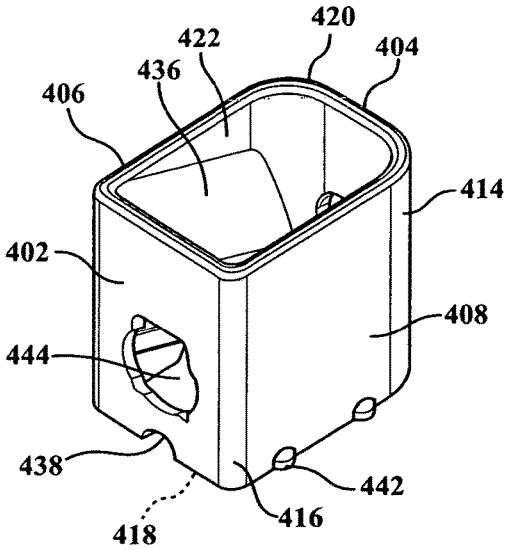
FIG. 6 is an isometric aft view of the magazine guide.
Figure 7:
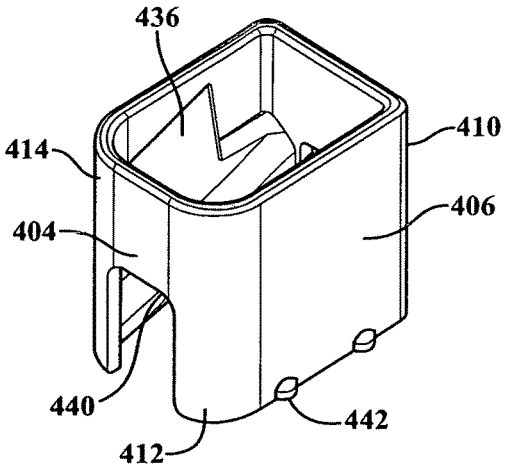
FIG. 7 is an isometric fore view of the magazine guide.
Figure 8:
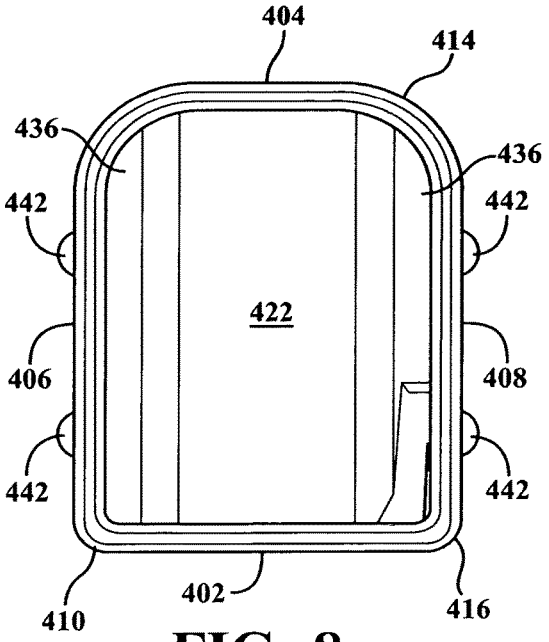
FIG. 8 is a top view of the magazine guide.
Figure 9:
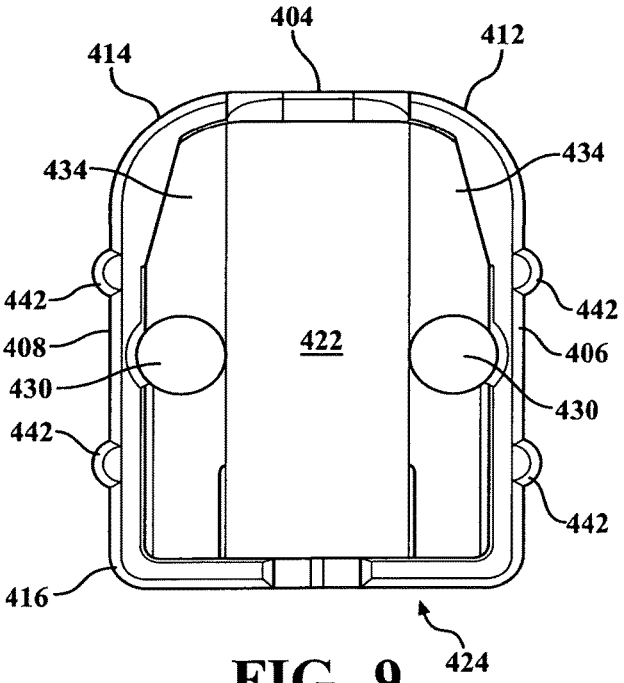
FIG. 9 is a bottom view of the magazine guide.
Figure 10:
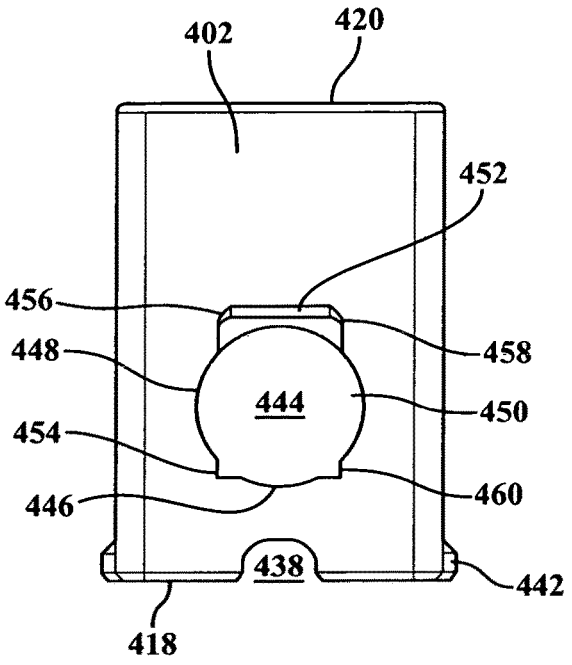
FIG. 10 is an aft of the magazine guide.
Figure 11:
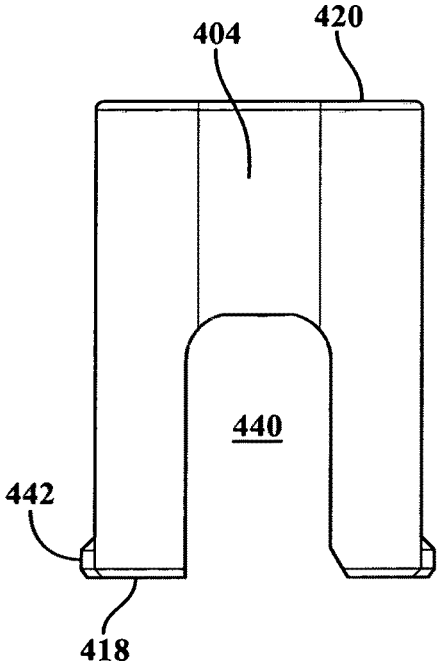
FIG. 11 is a fore view of the magazine guide.
Figure 12:
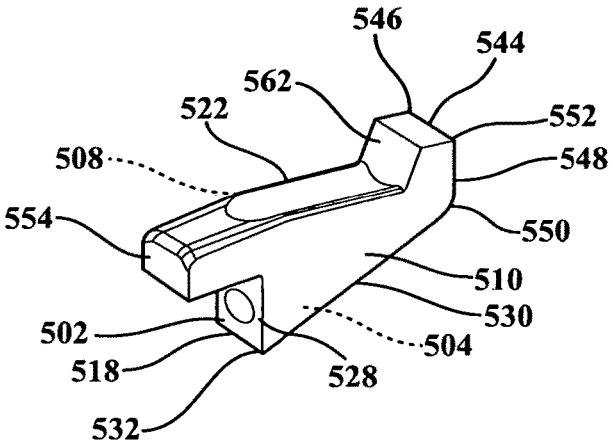
FIG. 12 is an aft iso view of the guide slide.
Figure 13:
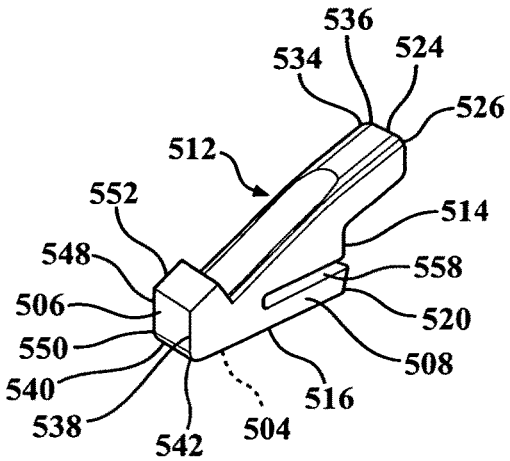
FIG. 13 is a fore iso view of the guide slide.
Figure 14:
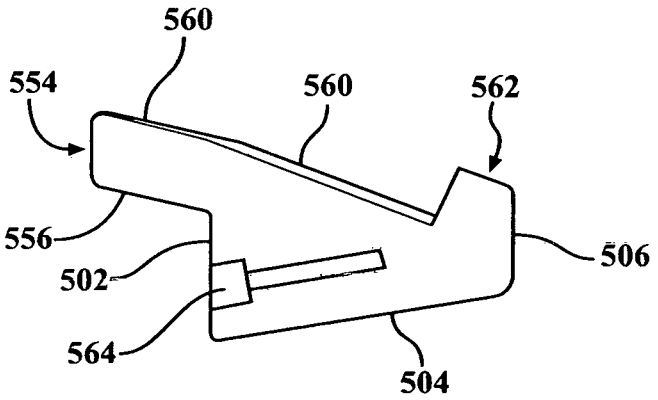
FIG. 14 is a right side view of the guide slide.
Figure 15:
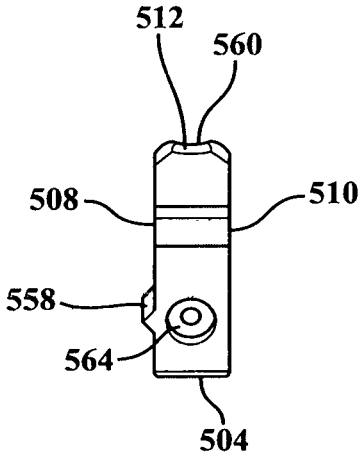
FIG. 15 is an aft view of the guide slide.
Figure 16:
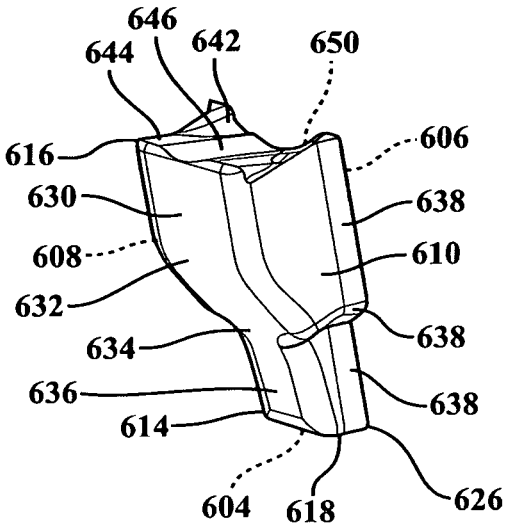
FIG. 16 is an aft isometric view of the guide cover.
Figure 17:
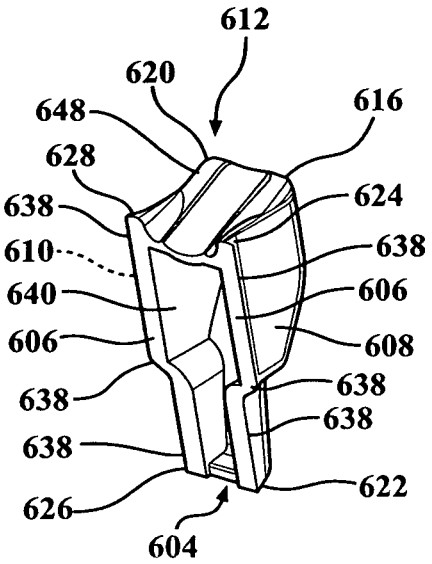
FIG. 17 is a fore isometric view of the guide cover.
Figure 18:
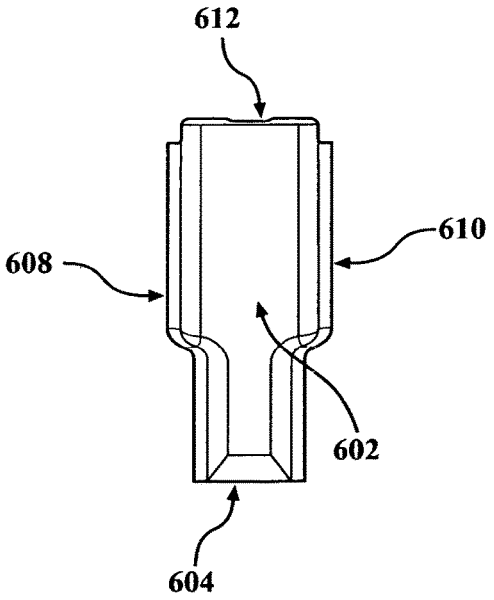
FIG. 18 is a fore view of the guide cover.
Figure 19:
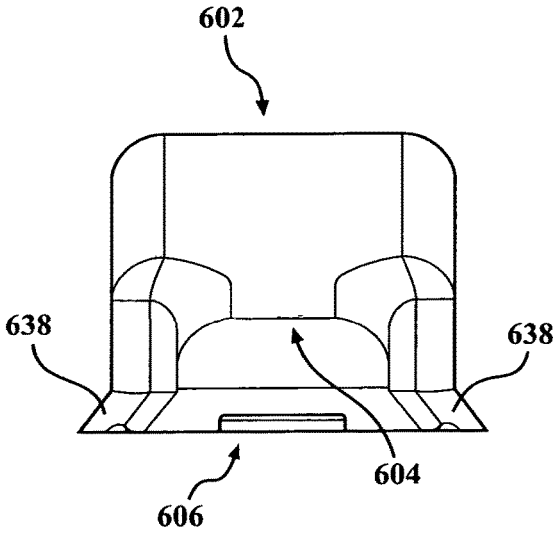
FIG. 19 is a bottom view of the guide cover.
Figure 20:
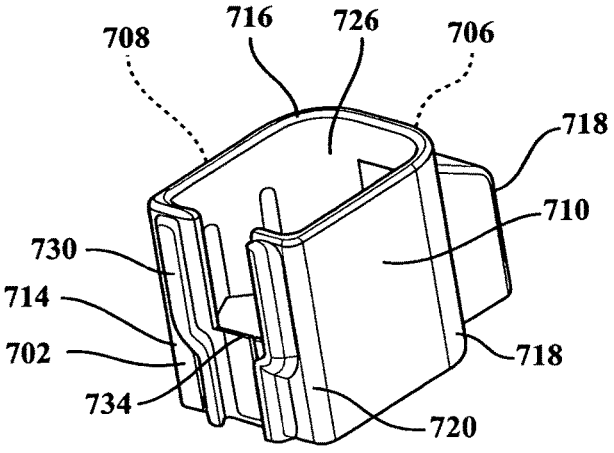
FIG. 20 is an aft isometric view of the housing.
Figure 21:
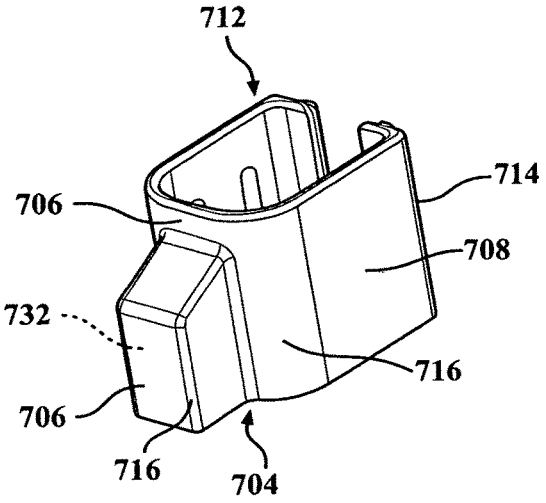
FIG. 21 is a fore isometric view of the housing.
Figure 22:
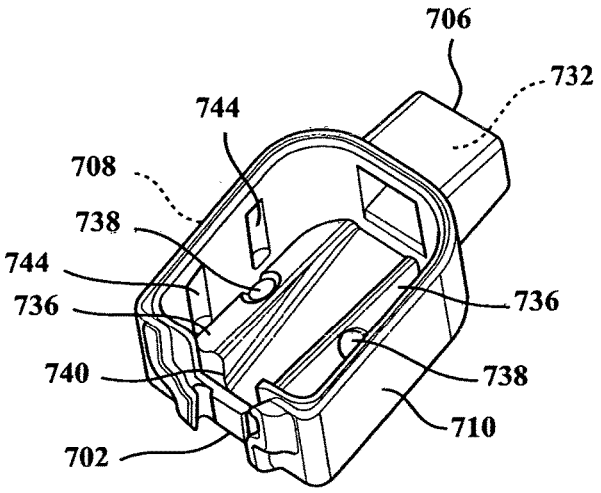
FIG. 22 is a top isometric view of the housing.
Figure 23:
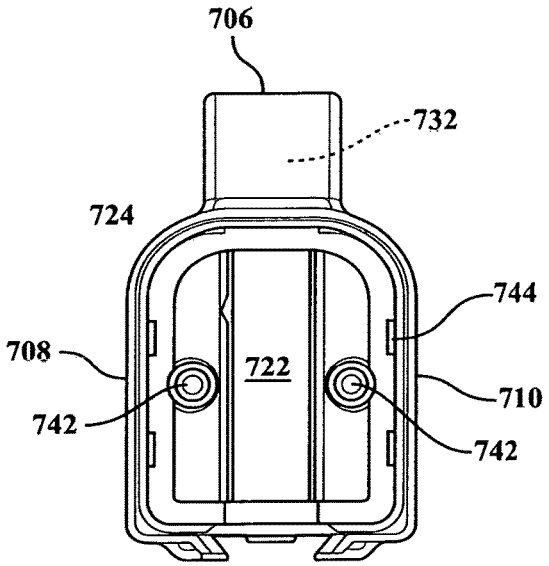
FIG. 23 is a top of the housing.
Figure 24:
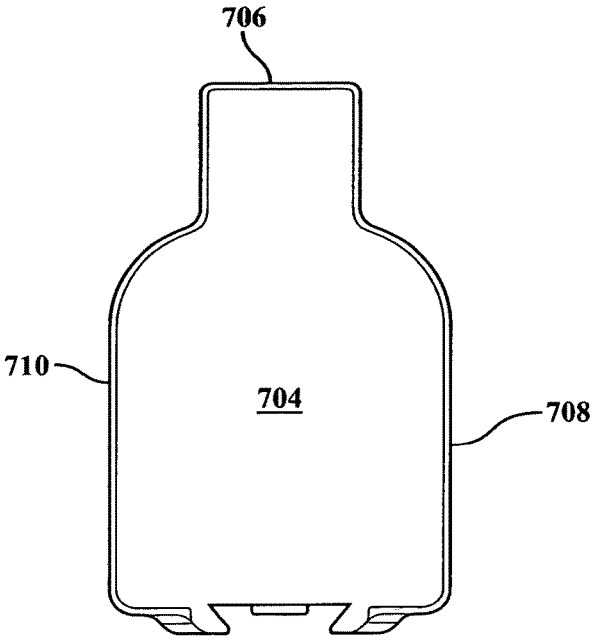
FIG. 24 is a bottom view of the housing.

Referring to FIGS. 1 through 24, there is shown, a firearm cartridge 100, a firearm magazine 200, a firearm magazine loader 300, a magazine guide housing spring 302, a guide slide housing spring 304, a magazine guide 400, a guide slide 500, a guide cover 600, and a housing 700. The firearm magazine loader 300 permits a user to load the firearm cartridge 100 into the firearm magazine 200 with minimal training, instruction, and effort.

According to an embodiment of the invention, a firearm magazine loader 300 is provided. The housing 700 is coupled to the guide slide 500. The housing 700 is coupled to the guide cover 600. The housing 700 is coupled to the magazine guide housing spring 302. The magazine guide 400 is coupled to the housing 700 by the magazine guide housing spring 302, connecting therebetween. The guide slide 500 is coupled to the housing 700 by the guide slide housing spring 304, connecting therebetween.

The magazine guide housing spring 302 has two ends. The guide slide housing spring 304 has two ends.

The magazine guide 400 includes a magazine guide aft wall 402, a magazine guide fore wall 404, a magazine guide left wall 406, a magazine guide right wall 408. The magazine guide aft wall 402 is disposed opposite the magazine guide fore wall 404. The magazine guide left wall 406 is disposed opposite the magazine guide right wall 408. The magazine guide aft wall 402 is connected to the magazine guide left wall 406 by a magazine guide aft-left wall 410 connecting therebetween. The magazine guide aft-left wall 410 may have an arcuate configuration. The magazine guide left wall 406 is connected to the magazine guide fore wall 404 by a magazine guide left-fore wall 412 connecting therebetween. The magazine guide left-fore wall 412 may have an arcuate configuration. The magazine guide fore wall 404 is connected to the magazine guide right wall 408 by a magazine guide fore-right wall 414 connecting therebetween. The magazine guide fore-right wall 414 may have an arcuate configuration. The magazine guide right wall 408 is connected to the magazine guide aft wall 402 by a magazine guide right-aft wall 416 connecting therebetween. The magazine guide right-aft wall 416 may have an arcuate configuration.

In at least one embodiment, the magazine guide aft-left wall 410 has a smaller radius of curvature than the magazine guide left-fore wall 412. In at least one embodiment, the magazine guide right-aft wall 416 has a smaller radius of curvature than the magazine guide fore-right wall 414. In at least one embodiment, the magazine guide aft-left wall 410 has a larger radius of curvature than the magazine guide left-fore wall 412. In at least one embodiment, the magazine guide right-aft wall 416 has a larger radius of curvature than the magazine guide fore-right wall 414. In at least one embodiment, the magazine guide aft-left wall 410 has a substantially similar radius of curvature as the magazine guide left-fore wall 412. In at least one embodiment, the magazine guide right-aft wall 416 has a substantially similar radius of curvature as the magazine guide fore-right wall 414. In at least one embodiment, the magazine guide aft-left wall 410 has a substantially similar radius of curvature as the magazine guide right-aft wall 416. In at least one embodiment, the magazine guide left-fore wall 412 has a substantially similar radius of curvature as the magazine guide fore-right wall 414.

The magazine guide 400 may have a magazine guide bottom 418 and a magazine guide top 420, where the magazine guide bottom 418 is disposed opposite the magazine guide top 420. The magazine guide 400 may be a hollow elongate member having a magazine guide interior 422 and a magazine guide exterior 424 disposed opposite the magazine guide interior 422. The magazine guide interior 422 may define a magazine guide bottom opening 426 in the magazine guide bottom 418. The magazine guide interior 422 may define a magazine guide top opening 428 in the magazine guide top 420. The magazine guide bottom opening 426 is disposed opposite the magazine guide top opening 428. The magazine guide interior 422 is coupled to a magazine guide cartridge guide 432. The magazine guide cartridge guide 432 may have a magazine guide cartridge guide bottom 434 and a magazine guide cartridge guide top 436. The magazine guide cartridge guide bottom 434 may be faceted to accommodate the cartridge to the firearm magazine loading process. The magazine guide cartridge guide top 436 may be faceted to accommodate the cartridge to the firearm magazine loading process. The magazine guide cartridge guide top 436 may include an interface for receiving and coupling to the firearm magazine.

The magazine guide bottom opening 426 may have a plurality of magazine guide housing spring retainer 430. In at least one embodiment, the magazine guide housing spring retainer 430 may be in the magazine guide interior 422, of the magazine guide aft wall 402. In at least one embodiment, the magazine guide housing spring retainer 430 may be in the magazine guide interior 422, of the magazine guide fore wall 404. In at least one embodiment, the magazine guide housing spring retainer 430 may be in the magazine guide interior 422, of the magazine guide left wall 406. In at least one embodiment, the magazine guide housing spring retainer 430 may be in the magazine guide interior 422, of the magazine guide right wall 408. In at least one embodiment, the magazine guide housing spring retainer 430 may be in the magazine guide interior 422, of the magazine guide aft-left wall 410. In at least one embodiment, the magazine guide housing spring retainer 430 may be in the magazine guide interior 422, of the magazine guide left-fore wall 412. In at least one embodiment, the magazine guide housing spring retainer 430 may be in the magazine guide interior 422, of the magazine guide fore-right wall 414. In at least one embodiment, the magazine guide housing spring retainer 430 may be in the magazine guide interior 422, of the magazine guide right-aft wall 416.

The magazine guide aft wall 402 may have a magazine guide guide slide arch 438. The magazine guide guide slide arch 438 assists the guide slide 500 in locating the cartridge 100 within the firearm magazine. The magazine guide fore wall 404 may have a magazine guide guide slide channel 440. The magazine guide guide slide channel 440 assists the guide slide 500 in locating the cartridge 100 within the firearm magazine.

The magazine guide exterior 424 may have a magazine guide housing stop 442. The magazine guide housing stop 422 extends outward from the magazine guide exterior 424. The magazine guide housing stop 442 couples the magazine guide 400 to the housing 700. The magazine guide housing stop 422 aligns the magazine guide 400 to the housing 700. In at least one embodiment the magazine guide housing stop 422 is substantially perpendicular to the magazine guide exterior 424.

The magazine guide aft wall 402 may have a magazine guide cartridge portal 444. The magazine guide cartridge portal 444 allows the cartridge to pass from the magazine guide exterior 424 to the magazine guide interior 422 (i.e. the magazine guide cartridge portal 444 is an opening through the magazine guide aft wall 402).

The magazine guide cartridge portal 444 includes a magazine guide cartridge portal bottom 446, a magazine guide cartridge portal left 448, a magazine guide cartridge portal right 450, and a magazine guide cartridge portal top 452. The magazine guide cartridge portal bottom 446 is disposed opposite the magazine guide cartridge portal top 452. The magazine guide cartridge portal left 448 is disposed opposite the magazine guide cartridge portal right 450. The magazine guide cartridge portal left 448 may be substantially similar to the magazine guide cartridge portal right 450, such that if the magazine guide cartridge portal 444 were bisected vertically the two halves may be substantially identical. The magazine guide cartridge portal bottom 446 is connected to the magazine guide cartridge portal left 448 by a magazine guide cartridge portal bottom-left corner 454 connecting therebetween. The magazine guide cartridge portal bottom-left corner 454 may have an arcuate configuration. The magazine guide cartridge portal left 448 is connected to the magazine guide cartridge portal top 452 by a magazine guide cartridge portal top-left corner 456 connecting therebetween. The magazine guide cartridge portal top-left corner 456 may have an arcuate configuration. The magazine guide cartridge portal top 452 is connected to the magazine guide cartridge portal right 450 by a magazine guide cartridge portal top-right corner 458 connecting therebetween. The magazine guide cartridge portal top-right corner 458 may have an arcuate configuration. The magazine guide cartridge portal right 450 is connected to the magazine guide cartridge portal bottom 446 by a magazine guide cartridge portal bottom-right corner 460 connecting therebetween. The magazine guide cartridge portal bottom-right corner 460 may have an arcuate configuration.

The magazine guide cartridge portal bottom 446 may have a substantially horizontal segment followed by a concave arc (i.e. a depression) followed by another substantially horizontal segment. The magazine guide cartridge portal left 448 may have a substantially vertical segment followed by a concave arc (i.e. the arc expands the size of the magazine guide cartridge portal 444) followed by another substantially vertical segment. The magazine guide cartridge portal right 450 may have a substantially vertical segment followed by a concave arc (i.e. the arc expands the size of the magazine guide cartridge portal 444) followed by another substantially vertical segment. The magazine guide cartridge portal top 452 may have a substantially horizontal segment followed by a concave arc (i.e. an arch) followed by another substantially horizontal segment.

The magazine guide cartridge portal 444 may be shaped to conform or accept the cartridge that the firearm magazine loader 300 may be sized to accept. For example, the magazine guide cartridge portal 444 for a 5.56 mm firearm will have a smaller perimeter than than the magazine guide cartridge portal 444 for a 9 mm firearm. As most cartridges are cylinders the non-circular segments of the magazine guide cartridge portal 444 provide clearance space for safety and manufacturing concerns.

The guide slide 500 includes a guide slide aft 502, a guide slide bottom 504, a guide slide fore 506, a guide slide left 508, a guide slide right 510, and a guide slide top 512. The guide slide aft 502 is disposed opposite the guide slide fore 506. The guide slide bottom 504 is disposed opposite the guide slide top 512. The guide slide left 508 is disposed opposite the guide slide right 510. The guide slide left 508 may be substantially parallel to the guide slide right 510. The guide slide left 508 may be substantially planar. The guide slide right 510 may be substantially planar.

The guide slide aft 502 is connected to the guide slide left 508 by a guide slide aft-left corner 514. The guide slide aft-left corner 514 may have a generally arcuate configuration. The guide slide left 508 is connected to the guide slide bottom 504 by a guide slide bottom-left corner 516. The guide slide bottom-left corner 516 may have a generally arcuate configuration. The guide slide aft 502 is connected to the guide slide bottom 504 by a guide slide aft-bottom corner 518. The guide slide aft-bottom corner 518 may have a generally arcuate configuration. The guide slide aft-left corner 514 and the guide slide bottom-left corner 516 and the guide slide aft-bottom corner 518 are connected to each other by the guide slide aft-bottom-left corner 520. The guide slide aft-bottom-left corner 520 may have a generally arcuate configuration.

The guide slide left 508 is connected to the guide slide top 512 by a guide slide left-top corner 522. The guide slide left-top corner 522 may have a generally arcuate configuration. The guide slide aft 502 is connected to the guide slide top 512 by a guide slide aft-top corner 524. The guide slide aft-top corner 524 may have a generally arcuate configuration. The guide slide aft-left corner 514 and the guide slide aft-top corner 524 and the guide slide left-top corner 522 are connected to each other by the guide slide aft-left-top corner 526. The guide slide aft-left-top corner 526 may have a generally arcuate configuration.

The guide slide aft 502 is connected to the guide slide right 510 by a guide slide aft-right corner 528. The guide slide aft-right corner 528 may have a generally arcuate configuration. The guide slide right 510 is connected to the guide slide bottom 504 by a guide slide bottom-right corner 530. The guide slide bottom-right corner 530 may have a generally arcuate configuration. The guide slide aft-right corner 528 and the guide slide bottom-right corner 530 and the guide slide aft-bottom corner 518 are connected to each other by the guide slide aft-bottom-right corner 532. The guide slide aft-bottom-right corner 532 may have a generally arcuate configuration.

The guide slide right 510 is connected to the guide slide top 512 by a guide slide right-top corner 534. The guide slide right-top corner 534 may have a generally arcuate configuration. The guide slide aft-right corner 514 and the guide slide aft-top corner 524 and the guide slide right-top corner 534 are connected to each other by the guide slide aft-right-top corner 536. The guide slide aft-right-top corner 536 may have a generally arcuate configuration.

The guide slide fore 506 is connected to the guide slide left 508 by a guide slide fore-left corner 538. The guide slide fore-left corner 538 may have a generally arcuate configuration. The guide slide fore 506 is connected to the guide slide bottom 504 by a guide slide bottom-fore corner 540. The guide slide bottom-fore corner 540 may have a generally arcuate configuration. The guide slide fore-left corner 538 and the guide slide bottom-left corner 516 and the guide slide bottom-fore corner 540 are connected to each other by the guide slide bottom-fore-left corner 542. The guide slide_bottom-fore-left corner 542 may have a generally arcuate configuration.

The guide slide fore 506 is connected to the guide slide top 512 by a guide slide fore-top corner 544. The guide slide fore-top corner 544 may have a generally arcuate configuration. The guide slide fore-left corner 514 and the guide slide fore-top corner 544 and the guide slide left-top corner 522 are connected to each other by the guide slide fore-left-top corner 546. The guide slide fore-left-top corner 546 may have a generally arcuate configuration.

The guide slide fore 506 is connected to the guide slide right 510 by a guide slide fore-right corner 548. The guide slide fore-right corner 548 may have a generally arcuate configuration. The guide slide fore-right corner 548 and the guide slide bottom-right corner 530 and the guide slide bottom-fore corner 540 are connected to each other by the guide slide bottom-fore-right corner 550. The guide slide bottom-fore-right corner 550 may have a generally arcuate configuration.

The guide slide fore-right corner 548 and the guide slide fore-top corner 544 and the guide slide right-top corner 534 are connected to each other by the guide slide fore-right-top corner 552. The guide slide fore-right-top corner 552 may have a generally arcuate configuration.

The guide slide top 512 may have a guide slide groove 560 that cradles the firearm cartridge 100. The guide slide top 512 may have a guide slide groove 560 that may cradle the firearm cartridge 100. The guide slide top 512 may have a guide slide groove 560 that may cradle the firearm cartridge 100. The guide slide top 512 may have a guide slide groove 560 that may cradle the firearm cartridge 100. The guide slide groove 560 has a concavity (radius of curvature) that is substantially similar to the diameter of the firearm cartridge 100 that the firearm magazine loader 300 is designed to load (i.e. the guide slide groove 560 for a 5.56 mm pistol firearm cartridge 100 will have a smaller radius of curvature than the guide slide groove 560 for a 9 mm pistol firearm cartridge 100).

The guide slide top 512 may have a guide slide stop 562. The guide slide stop 562 is an extension of the guide slide top 512. The guide slide stop 562 extends away from the guide slide bottom 504. The guide slide stop 562 extends the surface of the guide slide left 508. The guide slide stop 562 extends the surface of the guide slide right 510. The guide slide stop 562 extends the surface of the guide slide fore 506. The guide slide stop 562 stops the motion of the firearm cartridge 100 as the firearm cartridge 100 is inserted into the firearm magazine loader 300 through the magazine guide cartridge portal 444 of the magazine guide aft wall 402. The guide slide stop 562 may cradle the firearm cartridge 100.

The guide slide aft 502 may have an elongated guide slide panhandle 554. The guide slide panhandle 554 is an extension of the guide slide aft 502. The guide slide panhandle 554 extends away from the guide slide fore 506. The guide slide panhandle 554 extends the surface of the guide slide left 508. The guide slide panhandle 554 extends the surface of the guide slide right 510. The guide slide panhandle 554 extends the surface of the guide slide top 512. The guide slide top 512 section that is disposed above the guide slide panhandle 554 may incorporate a guide slide groove 560. The guide slide panhandle 554 has a guide slide panhandle bottom 556. The guide slide panhandle 554 couples the guide slide 500 to the housing 700.

The guide slide aft 502 may have a guide slide housing spring retainer 564. The guide slide housing spring retainer 564 may couple the guide slide 500 to an end of the guide slide housing spring 304. The guide slide housing spring retainer 564 may be parallel to the guide slide bottom 504.

The guide slide right 510 may have a guide slide rail 558. The guide slide rail 558 may slidably couple the guide slide 500 to the housing 700. The guide slide left 508 may have the guide slide rail 558. The guide slide rail 558 may slidably couple the guide slide 500 to the housing 700. The guide slide rail 558 may be polygonal in cross-section. The guide slide rail 558 may be arcuate in cross-section. The guide slide rail 558 may be linear. The guide slide rail 558 may be curved.

The guide cover 600 includes a guide cover aft 602, a guide cover bottom 604, a guide cover fore 606, a guide cover left 608, a guide cover right 610, and a guide cover top 612. The guide cover aft 602 is disposed opposite the guide cover fore 606. The guide cover bottom 604 is disposed opposite the guide cover top 612. The guide cover left 612 is disposed opposite the guide cover right 610. The guide cover left 608 may be substantially parallel to the guide cover right 610.

The guide cover aft 602 is connected to the guide cover left 608 is connected to the guide cover bottom 604 by a guide cover aft-left-bottom corner 614 connecting therebetween. The guide cover aft-left-bottom corner 614 may have an arcuate configuration. The guide cover aft 602 is connected to the guide cover left 608 is connected to the guide cover top 612 by a guide cover aft-left-top corner 616 connecting therebetween. The guide cover aft-left-top corner 616 may have an arcuate configuration. The guide cover aft 602 is connected to the guide cover right 610 is connected to the guide cover bottom 604 by a guide cover aft-right-bottom corner 618 connecting therebetween. The guide cover aft-right-bottom corner 618 may have an arcuate configuration. The guide cover aft 602 is connected to the guide cover right 610 is connected to the guide cover top 612 by a guide cover aft-right-top corner 620 connecting therebetween. The guide cover aft-right-top corner 620 may have an arcuate configuration.

The guide cover fore 606 is connected to the guide cover left 608 is connected to the guide cover bottom 604 by a guide cover fore-left-bottom corner 622 connecting therebetween. The guide cover fore-left-bottom corner 622 may have an arcuate configuration. The guide cover fore 606 is connected to the guide cover left 608 is connected to the guide cover top 612 by a guide cover fore-left-top corner 624 connecting therebetween. The guide cover fore-left-top corner 624 may have an arcuate configuration. The guide cover fore 606 is connected to the guide cover right 610 is connected to the guide cover bottom 604 by a guide cover fore-right-bottom corner 626 connecting therebetween. The guide cover fore-right-bottom corner 626 may have an arcuate configuration. The guide cover fore 606 is connected to the guide cover right 610 is connected to the guide cover top 612 by a guide cover fore-right-top corner 628 connecting therebetween. The guide cover fore-right-top corner 628 may have an arcuate configuration.

The guide cover aft 602 may have a substantially planar guide cover aft-top 630 segment connected to a guide cover aft-convex 632 segment connected to a guide cover aft-concave 634 segment connected to a substantially planar guide cover aft-bottom 636 segment.

The guide cover bottom 604 may have a guide cover housing rail 638 that couples the guide cover 600 to the housing 700. The guide cover housing rail 638 may be a ridge disposed between the guide cover bottom 604 and at least one of the guide cover fore 606, the guide cover left 608, and the guide cover right 610.

The guide cover fore 606 may be substantially planar.

The guide cover 600 may be a hollow elongate member having a guide cover interior 640.

The guide cover left 608 may have a guide cover housing rail 638 that couples the guide cover 600 to the housing 700. The guide cover right 610 may have a guide cover housing rail 638 that couples the guide cover 600 to the housing 700.

The guide cover top 612 may have a guide cover top-left-concave 642 segment extending to a substantially guide cover top-left-planar 644 segment extending to a guide cover groove 646 segment extending to a substantially guide cover top-right-planar 648 segment extending to a guide cover top-right-concave 650 segment.

The housing 700 includes a housing aft wall 702, a housing bottom 704, a housing fore wall 706, a housing left wall 708, a housing right wall 710, and a housing top 712. The housing aft wall 702 is disposed opposite the housing fore wall 706. The housing left wall 708 is disposed opposite the housing right wall 710. The housing aft wall 702 is connected to the housing left wall 708 by a housing aft-left wall 714 connecting therebetween. The housing aft-left wall 714 may have an arcuate configuration. The housing left wall 708 is connected to the housing fore wall 706 by a housing left-fore wall 716 connecting therebetween. The housing left-fore wall 716 may have an arcuate configuration. The housing fore wall 706 is connected to the housing right wall 710 by a housing fore-right wall 718 connecting therebetween. The housing fore-right wall 718 may have an arcuate configuration. The housing right wall 710 is connected to the housing aft wall 702 by a housing right-aft wall 720 connecting therebetween. The housing right-aft wall 720 may have an arcuate configuration. The housing bottom 704 is disposed opposite the housing top 712. The housing bottom 704 is perpendicular to the housing aft wall 702, housing fore wall 706, housing left wall 708, and housing right wall 710. The housing bottom 704 connects the housing aft wall 702, housing fore wall 706, housing left wall 708, and housing right wall 710. The housing top 712 is perpendicular to the housing aft wall 702, housing fore wall 706, housing left wall 708, and housing right wall 710.

In at least one embodiment, the housing aft-left wall 714 has a smaller radius of curvature than the housing left-fore wall 716. In at least one embodiment, the housing right-aft wall 720 has a smaller radius of curvature than the housing fore-right wall 718. In at least one embodiment, the housing aft-left wall 714 has a larger radius of curvature than the housing left-fore wall 716. In at least one embodiment, the housing right-aft wall 720 has a larger radius of curvature than the housing fore-right wall 718. In at least one embodiment, the housing aft-left wall 714 has a substantially similar radius of curvature as the housing left-fore wall 716. In at least one embodiment, the housing right-aft wall 720 has a substantially similar radius of curvature as the housing fore-right wall 718. In at least one embodiment, the housing aft-left wall 714 has a substantially similar radius of curvature as the housing right-aft wall 720. In at least one embodiment, the housing left-fore wall 716 has a substantially similar radius of curvature as the housing fore-right wall 718.

The housing 700 may be configured as a hollow elongate member having a housing interior 722 and a housing exterior 724 disposed opposite the housing interior 722. The housing interior 722 may define a housing top opening 726 within the housing top 712. The housing top opening 726 extends from the housing top 712 towards the housing bottom 704. The housing interior 722 may define a housing bottom opening within the housing bottom 704. The housing bottom opening extends from the housing bottom 704 towards the housing top 712.

The housing interior 722 in the housing fore wall 706 may have a housing guide slide pocket 732. The housing guide slide pocket 732 may be a hollow polygonal prism. The housing guide slide pocket 732 may have curved segments. The housing guide slide pocket 732 extends the volume of the housing interior 722. The housing guide slide pocket 732 slidably receives the housing 700 to the guide slide 500.

The housing aft wall 702 may have a housing guide cover channel 730. The housing guide cover channel 730 of the housing 700 couples to the guide cover housing rail 638 to the guide cover 600. The housing guide cover channel 730 may substantially mirror the guide cover housing rail 638.

The housing 700 may have a housing guide slide panhandle shelf 734. The housing guide slide panhandle shelf 734 couples the housing 700 the guide slide panhandle 554 of the guide slide 500.

The housing interior 722 may have a housing interior guide slide guide 736. The housing interior guide slide guide 736 slidably receives the housing 700 to the guide slide 500. The housing interior guide slide guide 736 may have a housing magazine guide spring retainer 738. The housing magazine guide spring retainer 738 couples the housing 700 to the magazine guide housing spring 302. The housing interior 722 may have the housing magazine guide spring retainer 738.

The housing interior guide slide guide 736 may have a housing interior guide slide channel 740. The housing interior guide slide channel 740 slidably couples the housing 700 to the guide slide rail 558 of the guide slide 500.

The housing interior 722 may have a housing guide slide spring retainer 742. The housing interior 722 in the housing fore wall 706 may have the housing guide slide spring retainer 742. The housing guide slide spring retainer 742 couples the housing 700 to the guide slide housing spring 304.

The housing interior 722 may have a housing magazine guide channel 744. The housing magazine guide channel 744 couples the housing 700 to the magazine guide housing stop 442 of the magazine guide 400.

The housing interior 722 in the housing bottom 704 may have a housing magazine guide trough 746. The housing magazine guide trough 746 is spaced apart from and is circumscribed by the housing aft wall 702, the housing fore wall 706, the housing left wall 708, and the housing right wall 710. The housing magazine guide trough 746 slidably receives the housing 700 to the magazine guide aft wall 402, the magazine guide fore wall 404, magazine guide left wall 406, and the magazine guide right wall 408 of the magazine guide 400.

For operation of the firearm magazine loader 300. A firearm magazine 200 is fitted into the magazine guide 400 by insertion through the magazine guide top opening 428. A firearm cartridge 100 is inserted through the magazine guide cartridge portal 444 by traveling down the guide cover groove 646. The firearm cartridge 100 is cradled by the guide slide 500 with the travel of the firearm cartridge 100, during insertion, stopped by the guide slide stop 562 and the firearm cartridge 100 is cradled by the guide slide top 512.

Depressing the magazine guide 400 into the housing 700 compresses the magazine guide housing spring 302 and guide slide housing spring 304. This allows the firearm cartridge 100 to be forced past magazine guide cartridge guide 432 by the motion of the guide slide 500 and seat within the firearm magazine 200 with minimal time and effort.

The decompression of the magazine guide housing spring 302 and the guide slide housing spring 304, after release of the magazine guide 400 allows the firearm magazine loader 300 to return to a rest position to readily receive another firearm cartridge 100 and repeat the magazine loading process.

In at least one embodiment, the firearm magazine loader may have a housing 700 having a housing aft wall 702 that is disposed opposite a housing fore wall 706, a housing left wall 708 that extends between the housing aft wall 702 and the housing fore wall 706, and a housing right wall 710 that is disposed opposite the housing left wall 708 that extends between the housing aft wall 702 and the housing fore wall 706, the housing aft wall 702 defining a housing cover channel 730 that extends from a housing top 712 towards a housing guide slide panhandle shelf 734 disposed proximate a housing bottom 704; and a magazine guide 400 that is at least partially received within the housing 700, the magazine guide 400 having a magazine guide aft wall 402 that is disposed opposite a magazine guide fore wall 404 and that is disposed proximate and substantially parallel to the housing aft wall 702, a magazine guide left wall 406 that extends between the magazine guide aft wall 402 and the magazine guide fore wall 404, and a magazine guide right wall 408 that is disposed opposite the magazine guide left wall 406 and that extends between the magazine guide aft wall 402 and the magazine guide fore wall 404, the magazine guide aft wall 402 defining a magazine guide cartridge portal 444 that is proximately aligned with the housing guide cover channel 730.

The firearm magazine loader may have a guide slide 500 that is at least partially disposed within the housing 700 and is operatively connected to the magazine guide 400 by a magazine guide housing spring 302.

The firearm magazine loader may have a guide slide 500 that has a guide slide aft face 502, a guide slide panhandle 554 extending from the guide slide aft face 502, a guide slide fore face 506 that is disposed opposite the guide slide aft face 502, a guide slide right face 510 extending between the guide slide aft face 502 and the guide slide fore face 506, a guide slide left face 508 that is disposed opposite the guide slide right face 510 and extending between the guide slide aft face 502 and the guide slide fore face 506, a guide slide top face 512 extending along the guide slide panhandle 554 and between the guide slide aft face 502, the guide slide fore face 506, the guide slide right face 510, and the guide slide left face 508, and a guide slide bottom face 504 that is disposed opposite the guide slide top face 512.

The firearm magazine loader may have a guide slide panhandle 554 that least partially extends through the housing cover channel 730.

The firearm magazine loader may have a guide slide panhandle 554 that may be configured to engage the housing guide slide panhandle shelf 734.

The firearm magazine loader may have a guide slide top face 512 that may define a guide slide stop 562 that extends from the guide slide top face 512.

The firearm magazine loader may have a guide slide top face 512 that may define a guide slide groove 560 that extends between the guide slide aft face 502 and the guide slide fore face 506, the groove is configured to receive a cartridge that is inserted through magazine guide cartridge portal 444.

The firearm magazine loader may have a guide slide aft face 502 that may define a guide slide housing spring retainer 564 that extends towards the guide slide fore face 506.

The firearm magazine loader may have a guide cover 600 that may slidably engage with the housing aft wall 702. The guide cover 600 may have a guide cover body 602, having a guide cover top 612 that extends towards the guide slide top 512. The guide cover top 612 may define a guide cover groove 646.

In at least one embodiment, the firearm magazine loader 300 may have a housing 700 having a housing guide slide pocket 732 that is defined by a housing bottom 704 and a housing aft wall 702 extending from the housing bottom 704, a housing left wall 708 disposed adjacent to the housing aft wall 702 and extending from the housing bottom 704, a housing fore wall 706 disposed adjacent to the housing left wall 708 and extending from the housing bottom 704, and a housing right wall 710 disposed adjacent to the housing fore wall 706 and extending from the housing bottom 704;

The firearm magazine loader 300 may have a magazine guide 400 that may be partially received within the housing guide slide pocket 732, the magazine guide 400 having a magazine guide aft wall 402, a magazine guide left wall 406 that is disposed adjacent to the magazine guide aft wall 402, a magazine guide fore wall 404 that is disposed adjacent to the magazine guide left wall 406, a magazine guide right wall 408 that is disposed adjacent to the magazine guide fore wall 404; and a guide slide 500 that is received within the housing guide slide pocket 732, the guide slide 500 having a guide slide panhandle 554 that extends from the guide slide aft face and extends through the housing aft wall 702, a guide slide stop 562 that extends from the guide slide fore face and is disposed proximate the housing fore wall 706, a guide slide top 512 having a guide slide groove 560 extending between the guide slide stop 562 and the guide slide panhandle 554, and a guide slide left face and a guide slide right face each extending from the guide slide top 512 towards a guide slide bottom 504 that engages the housing bottom 504.

The firearm magazine loader 300 may have a guide cover 600 that may slidably engage the housing aft wall 702, the guide cover 600 having a guide cover top 612, a guide cover fore 606 that is disposed adjacent to the guide cover top 612, and the guide cover fore 606 is partially received within the housing aft wall 702.

The firearm magazine loader 300 may have a magazine guide housing spring 302 that may have a magazine guide housing spring first end connected to an interior surface of at least one of the housing left wall 708 and the housing right wall 710 and a magazine guide housing spring second end connected to an interior surface of at least one of the magazine guide left wall 406 and the magazine guide right wall 408.

The firearm magazine loader 400 may have a guide slide housing spring 302 that may have a guide slide housing spring first end connected to an interior surface of the housing aft wall 702 and a guide slide housing spring second end connected to the guide slide housing spring retainer 564.

The firearm magazine loader 300 may have a magazine guide aft wall 402 that contains a magazine guide cartridge portal 444, the magazine guide cartridge portal 444 aligns with at least one of the guide cover top 612 and the guide slide groove 560.

The firearm magazine loader 300 may have a guide slide 500 where at least one of the guide slide left face and the guide slide right face includes a guide slide rail 558 that slidably couples with at least one of an interior surface of the housing left wall 708 and an interior surface of the housing right wall 710.

The firearm magazine loader 300 may have a magazine guide 400 where the exterior of at least one of the magazine guide left wall 406 and magazine guide right wall 408 includes a magazine guide housing stop 442 that engages an interior surface of at least one of the housing left wall 708 and the housing right wall 710.

The firearm magazine loader 300 may have a housing 700, where the housing aft wall 702 includes a slot extending from a housing top 712 towards the housing bottom 704 terminating in a housing guide slide panhandle shelf 734, the guide slide panhandle 554 engages the housing guide slide panhandle shelf 734.

The firearm magazine loader 300 may have a housing 700 where the interior of the housing bottom 704 includes a housing magazine guide trough 746, wherein the housing magazine guide trough 746 partially receives the magazine guide 400.

In at least one embodiment, of the firearm magazine loader 300, the cover guide 600 is affixed to the housing 700.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A firearm magazine loader comprising:

a housing having a housing aft wall that is disposed opposite a housing fore wall, a housing left wall that extends between the housing aft wall and the housing fore wall, and a housing right wall that is disposed opposite the housing left wall that extends between the housing aft wall and the housing fore wall, the housing aft wall defining a housing cover channel that extends from a housing top towards a housing guide slide panhandle shelf disposed proximate a housing bottom; and a magazine guide that is at least partially received within the housing, the magazine guide having a magazine guide aft wall that is disposed opposite a magazine guide fore wall and that is disposed proximate and substantially parallel to the housing aft wall, a magazine guide left wall that extends between the magazine guide aft wall and the magazine guide fore wall, and a magazine guide right wall that is disposed opposite the magazine guide left wall and that extends between the magazine guide aft wall and the magazine guide fore wall, the magazine guide aft wall defining a magazine guide cartridge portal that is proximately aligned with the housing guide cover channel;

a guide slide that is at least partially disposed within the housing and is operatively connected to the magazine guide by a magazine guide housing spring; and wherein the guide slide has a guide slide aft face, a guide slide panhandle extending from the guide slide aft face, a guide slide fore face that is disposed opposite the guide slide aft face, a guide slide right face extending between the guide slide aft face and the guide slide fore face, a guide slide left face that is disposed opposite the guide slide right face and extending between the guide slide aft face and the guide slide fore face, a guide slide top face extending along the guide slide panhandle and between the guide slide aft face, the guide slide fore face, the guide slide right face, and the guide slide left face, and a guide slide bottom face that is disposed opposite the guide slide top face.

2. The firearm magazine loader of claim 1, wherein the guide slide panhandle at least partially extends through the housing cover channel.

3. The firearm magazine loader of claim 2, wherein the guide slide panhandle is configured to engage the housing guide slide panhandle shelf.

4. The firearm magazine loader of claim 2, wherein the guide slide top face defines a guide slide stop that extends from the guide slide top face.

5. The firearm magazine loader of claim 4, wherein the guide slide top face defines a guide slide groove that extends between the guide slide aft face and the guide slide fore face, the groove is configured to receive a cartridge that is inserted through magazine guide cartridge portal.

6. The firearm magazine loader of claim 5, wherein the guide slide aft face defines a guide slide housing spring retainer that extends towards the guide slide fore face.

7. The firearm magazine loader of claim 6, further comprising: a guide cover that is slidably engaged with the housing aft wall.

8. The firearm magazine loader of claim 7, wherein the guide cover has a guide cover body, having a guide cover top that extends towards the guide slide top.

9. The firearm magazine loader of claim 8, wherein the guide cover op defines a guide cover groove.

* * * * *